US010683832B2

(12) United States Patent
Yoon et al.

(10) Patent No.: US 10,683,832 B2
(45) Date of Patent: Jun. 16, 2020

(54) EXHAUST GAS RECIRCULATION COOLER

(71) Applicants: HYUNDAI MOTOR COMPANY, Seoul (KR); KIA MOTORS CORPORATION, Seoul (KR)

(72) Inventors: Sung Il Yoon, Seoul (KR); Dong Young Lee, Goyang-Si (KR); Do Jun Park, Hwaseong-Si (KR); Seogjin Yoon, Suwon-Si (KR); In Sung Yun, Seoul (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 16/204,528

(22) Filed: Nov. 29, 2018

(65) Prior Publication Data

US 2020/0018266 A1 Jan. 16, 2020

(30) Foreign Application Priority Data

Jul. 11, 2018 (KR) ..... 10-2018-0080561

(51) Int. Cl.
*F02M 26/23* (2016.01)
*F28F 1/02* (2006.01)
(Continued)

(52) U.S. Cl.
CPC ..... *F02M 26/29* (2016.02); *F02M 26/23* (2016.02); *F28F 1/022* (2013.01); *F28F 1/045* (2013.01);
(Continued)

(58) Field of Classification Search
CPC . F02M 26/29; F02M 26/23; F28F 1/02; F28F 1/40; F28F 1/045; F28F 9/22;
(Continued)

(56) References Cited

U.S. PATENT DOCUMENTS 6,247,523 B1 * 6/2001 Shibagaki ..... F28D 9/0043 165/51
7,320,358 B2 * 1/2008 Kaspar ..... F28F 9/002 165/166
(Continued)

FOREIGN PATENT DOCUMENTS

JP 5079597 B2 11/2012
JP 2012-247093 A 12/2012
(Continued)

OTHER PUBLICATIONS

Extended European Search Report issued in European Patent Application No. 18208546.4 dated May 13, 2019.

*Primary Examiner* — George C Jin
(74) *Attorney, Agent, or Firm* — Morgan, Lewis & Bockius LLP

(57) ABSTRACT

An exhaust gas recirculation (EGR) cooler includes: a housing having an exhaust gas inlet and an exhaust gas outlet, a coolant inlet and a coolant outlet, and a plurality of grooves protruding inward from upper and lower surfaces of the housing; a plurality of tubes spaced apart from each other so that exhaust gas flows in the housing; and a plurality of supporters supporting the plurality of tubes in the housing, wherein the plurality of supporters are disposed between an upper surface of the housing and a tube adjacent the upper surface of the housing among the plurality of tubes, between an lower surface of the housing and a tube adjacent the lower surface of the housing among the plurality of tubes, and between the plurality of tubes so that the plurality of supporters are disposed in a space in which the coolant flows inside the housing.

6 Claims, 4 Drawing Sheets

(51) Int. Cl.

| | |
|---|---|
| ***F02M 26/29*** | (2016.01) |
| ***F28F 1/04*** | (2006.01) |
| ***F28F 1/40*** | (2006.01) |
| ***F28F 9/22*** | (2006.01) |
| *F28F 9/00* | (2006.01) |
| *F28F 9/02* | (2006.01) |

(52) U.S. Cl.
CPC ..... *F28F 1/40* (2013.01); *F28F 9/22* (2013.01); *F28F 9/002* (2013.01); *F28F 9/0229* (2013.01); *F28F 2009/226* (2013.01)

(58) Field of Classification Search
CPC ..... F28F 9/002; F28F 9/0229; F28F 9/001; F28F 2009/226; F02F 19/002; F02F 1/00
See application file for complete search history.

(56) References Cited

U.S. PATENT DOCUMENTS 10,113,515 B1 * 10/2018 Yoon ..... F02M 26/29
2001/0000879 A1 * 5/2001 Sugawara ..... F28F 9/002 165/67
2007/0209788 A1 * 9/2007 Jing ..... F28D 7/026 165/177
2007/0261830 A1 * 11/2007 Egawa ..... F28F 3/025 165/165
2008/0271722 A1 * 11/2008 Grunenwald ..... F28D 9/0043 123/568.12
2009/0186239 A1 * 7/2009 Sagawa ..... B23K 35/30 428/650
2009/0242180 A1 * 10/2009 Gonzales ..... B21C 37/151 165/153
2014/0182821 A1 * 7/2014 Perrin ..... B32B 15/016 165/109.1
2015/0308387 A1 * 10/2015 Tolosa Echarri ..... F28F 13/06 123/568.12
2017/0067416 A1 * 3/2017 Young ..... F02M 26/29
2018/0073470 A1 3/2018 Yoon et al.
2019/0017471 A1 * 1/2019 Sugimoto ..... F28F 9/22

FOREIGN PATENT DOCUMENTS

JP 2015-087090 A 5/2015
WO 2015/141884 A1 9/2015

* cited by examiner

EXHAUST GAS RECIRCULATION COOLER

CROSS-REFERENCE TO RELATED APPLICATION

This application claims priority to and the benefit of Korean Patent Application No. 10-2018-0080561 filed in the Korean Intellectual Property Office on Jul. 11, 2018, the entire contents of which are incorporated herein by reference.

TECHNICAL FIELD

The present disclosure relates to an exhaust gas recirculation (EGR) cooler, and more particularly, to an EGR cooler in which a tube is prevented from sagging downward due to a load when brazing the tube in a housing.

BACKGROUND

In general, an exhaust gas recirculation (EGR) device refers to a device for inhibiting the occurrence of nitrogen oxide (NOx) by recirculating a part of exhaust gas to an intake system to decrease a combustion temperature in a cylinder.

That is, the EGR device serves to recirculate a part of the exhaust gas discharged from an engine to an intake line, thereby reducing the amount of oxygen in a gaseous mixture, reducing the amount of discharged exhaust gas, and reducing hazardous substances in the exhaust gas.

The EGR device includes an EGR cooler that cools exhaust gas. The EGR cooler serves as a kind of heat exchanger that performs heat exchange between exhaust gas and a coolant, thereby preventing a temperature of the exhaust gas from being excessively increased.

Further, the EGR cooler includes a housing and multiple tubes stacked in the housing. In this case, coolant passageways are formed in the housing, and exhaust gas passageways are formed in the tubes. The multiple tubes are spaced apart from one another at predetermined intervals and stacked in the housing, and the multiple tubes are installed by being brazed to the housing.

However, the EGR cooler in the related art has a problem in that the tube sags downward due to its own weight when brazing the housing and the tube. In addition, the EGR cooler in the related art also has a problem in that the housing swells when testing the housing for a leakage of coolant.

The above information disclosed in this Background section is only for enhancement of understanding of the background of the invention, and therefore, it may contain information that does not form the prior art that is already known in this country to a person of ordinary skill in the art.

SUMMARY

The present disclosure has been made in an effort to provide an exhaust gas recirculation (EGR) cooler in which a housing and a tube are directly brazed together with a supporter through a plurality of grooves formed in upper and lower surfaces of the housing, thereby preventing the tube from sagging.

According to an exemplary embodiment of the present disclosure, an exhaust gas recirculation (EGR) cooler which receives exhaust gas and recirculates cooled exhaust gas, the EGR cooler comprising: a housing which has a cuboid shape and comprises an exhaust gas inlet and an exhaust gas outlet through which exhaust gas is introduced and discharged, respectively, a coolant inlet and a coolant outlet through which a coolant for cooling the exhaust gas is introduced and discharged, respectively, and a plurality of grooves protruding inward from upper and lower surfaces of the housing; a plurality of tubes spaced apart from each other in the housing so that exhaust gas, which flows from the exhaust gas inlet to the exhaust gas outlet, flows in the housing between the plurality of tubes; and a plurality of supporters supporting the plurality of tubes in the housing, wherein the plurality of supporters are disposed between an upper surface of the housing and a tube adjacent the upper surface of the housing among the plurality of tubes, between an lower surface of the housing and a tube adjacent the lower surface of the housing among the plurality of tubes, and between the plurality of tubes so that the plurality of supporters are disposed in a space in which the coolant flows inside the housing, wherein the supporter, which is disposed between the upper surface of the housing and the tube adjacent the upper surface of the housing, and the supporter, which is disposed between the lower surface of the housing and the tube adjacent the lower surface of the housing, are supported by the plurality of grooves and brazed together to be combined with the housing and the tube adjacent the upper surface of the housing and the tube adjacent the lower surface of the housing, respectively.

The housing may have a box shape made by overlapping and joining both end portions of a first panel in a longitudinal direction and both end portions of a second panel in a longitudinal direction, and the plurality of grooves may be formed in upper and lower surfaces of the first and second panels, respectively.

The supporter may have flat planar portions, multiple through holes formed between the planar portions, and multiple convex portions having predetermined sections which are disposed between the through holes and protrude toward one side.

Each of the plurality of grooves may be brazed in a state in which the forming portion is in contact with one side of the planar portion of the supporter disposed between the housing and the tube.

The housing may have a two-layer structure including a first base material and a first joining layer which is joined to one side surface of the first base material, and the tube may have a five-layer structure including a second base material which is formed at a center of the tube, diffusion prevention layers which are formed on both outer surfaces of the second base material, respectively, and second joining layers which are formed on outer surfaces of the diffusion prevention layers, respectively.

The supporter may be interposed between the housing and the tube and brazed by the first joining layer of the housing and the second joining layer of the tube.

The EGR cooler may further include cooling fins which are disposed in the tube and selectively joined, in a predetermined pattern, to upper and lower surfaces of the tube.

The predetermined pattern may have a concave-convex shape.

According to the exemplary embodiment of the present disclosure, the housing and the tube are brazed through the plurality of grooves formed in the upper and lower surfaces of the housing in the state in which the supporter is interposed between the housing and the tube, and as a result, it is possible to prevent the tube from sagging due to its own weight.

In addition, according to the exemplary embodiment of the present disclosure, the housing is directly joined to the supporter and the tube through the plurality of grooves, and as a result, it is possible to prevent the housing from swelling.

Accordingly, it is possible to prevent exhaust gas from leaking from the housing.

In addition, other effects, which may be obtained or expected by the exemplary embodiments of the present disclosure, will be directly or implicitly disclosed in the detailed description of the embodiments of the present disclosure. That is, various effects expected according to the exemplary embodiments of the present disclosure will be disclosed in the detailed description to be described below.

DETAILED DESCRIPTION OF THE EMBODIMENTS

Figure 1:
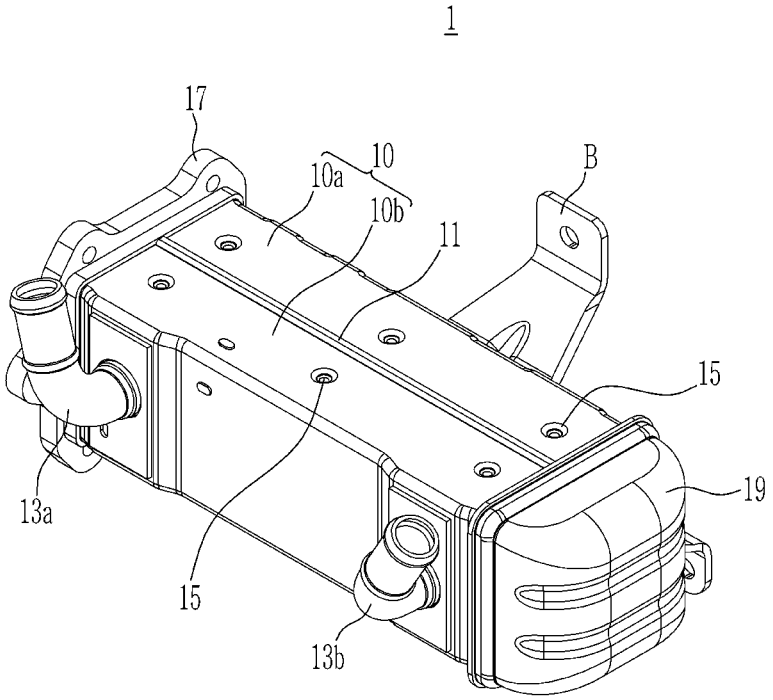
FIG. 1 is an assembled perspective view of an exhaust gas recirculation (EGR) cooler according to an exemplary embodiment of the present disclosure.

The present disclosure will be described more fully hereinafter with reference to the accompanying drawings, in which exemplary embodiments of the invention are shown. As those skilled in the art would realize, the described embodiments may be modified in various different ways, all without departing from the spirit or scope of the present disclosure.

The drawings and description are to be regarded as illustrative in nature and not restrictive. Like reference numerals designate like elements throughout the specification.

In the following description, dividing names of components into first, second and the like is to divide the names because the names of the components are the same as each other and an order thereof is not particularly limited.

Figure 2:
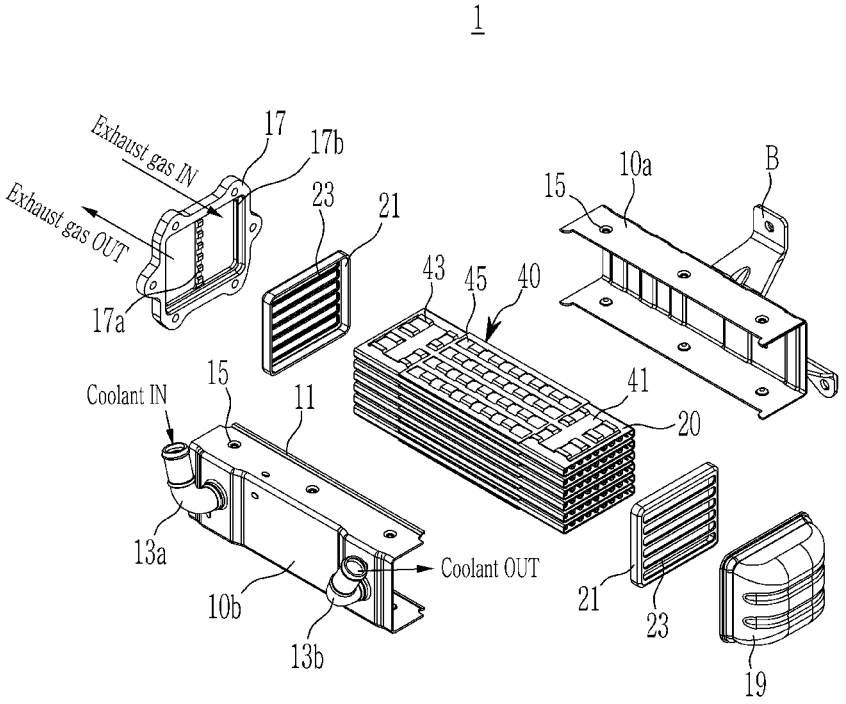
FIG. 2 is an exploded perspective view of the EGR cooler according to the exemplary embodiment of the present disclosure.
Figure 3:
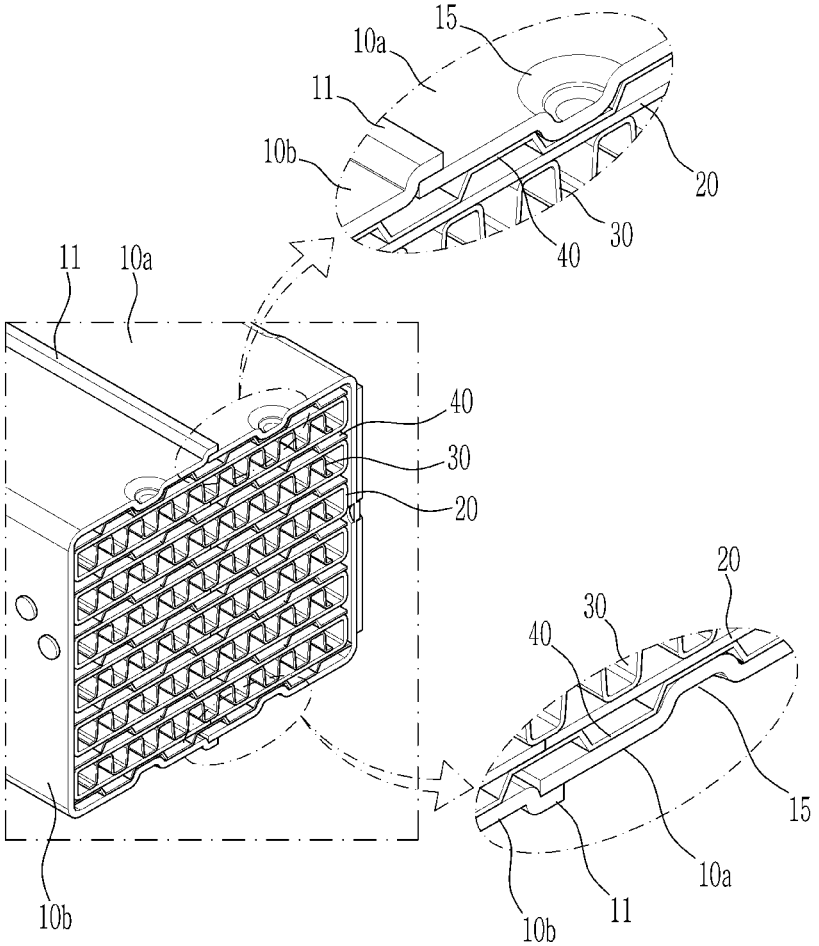
FIG. 3 is an assembled cross-sectional view of the EGR cooler according to the exemplary embodiment of the present disclosure.
Figure 4:
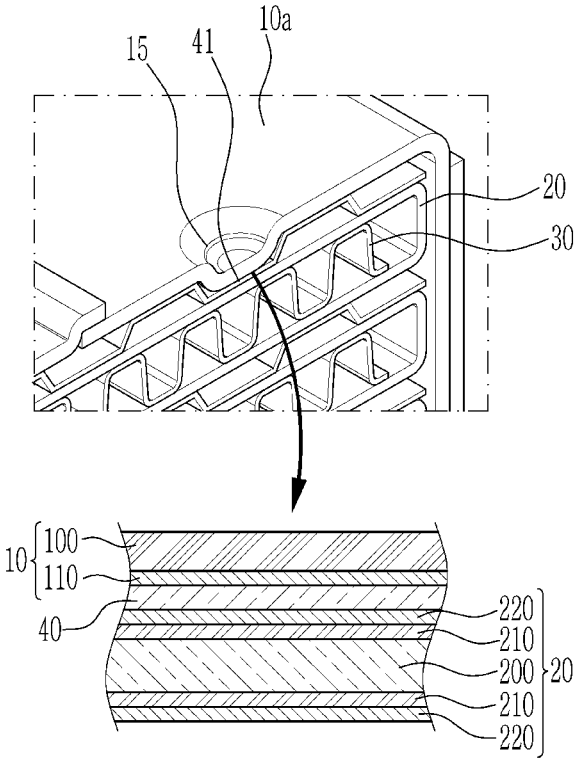
FIG. 4 is a view illustrating a material of the EGR cooler according to the exemplary embodiment of the present disclosure.

FIG. 1 is an assembled perspective view of an EGR cooler according to an exemplary embodiment of the present disclosure, FIG. 2 is an exploded perspective view of the EGR cooler according to the exemplary embodiment of the present disclosure, FIG. 3 is an assembled cross-sectional view of the EGR cooler according to the exemplary embodiment of the present disclosure, and FIG. 4 is a view illustrating a material of the EGR cooler according to the exemplary embodiment of the present disclosure.

An exhaust gas recirculation (EGR) device for a vehicle serves to prevent the occurrence of nitrogen oxide by recirculating a part of exhaust gas generated from an engine to an intake manifold to decrease a combustion temperature in a cylinder.

The EGR device includes an EGR cooler 1 which is installed between an exhaust manifold and the intake manifold and cools exhaust gas that moves from the exhaust manifold to the intake manifold.

In this case, the EGR cooler 1 performs heat exchange between the exhaust gas and a coolant, thereby preventing a temperature of the exhaust gas from being excessively increased. Further, the structure of the EGR cooler 1 may be applied to various heat exchangers.

Referring to FIGS. 1 to 3, the EGR cooler 1 according to an exemplary embodiment of the present disclosure includes a housing 10, tubes 20, cooling fins 30, and supporters 40.

The housing 10 has a box shape formed by coupling a first panel 10*a* and a second panel 10*b*.

In more detail, the housing 10 includes the first panel 10*a* having one side and the other side in a longitudinal direction which are bent in one direction, and the second panel 10*b* having one side and the other side in a longitudinal direction which are bent in one direction so as to correspond to the first panel 10*a*.

In this case, both ends of the second panel 10*b* in the longitudinal direction include joint portions 11 which are formed to be stepped outward to surround the first panel 10*a*. In some instances, the joint portions 11 may be formed on both ends of the first panel 10*a*.

The housing 10 may be manufactured through a press process.

As described above, an example in which the housing 10 includes the first panel 10*a* and the second panel 10*b* is described, but the present disclosure is not necessarily limited thereto, and the housing 10 may be integrally formed by extrusion or the like.

In addition, the housing 10 has therein coolant passageways.

The housing 10 is configured such that a coolant for cooling recirculating exhaust gas moves through the coolant passageways, and a coolant inlet port 13*a* and a coolant discharge port 13*b* are formed in the housing 10.

That is, the coolant is introduced into and discharged from the housing 10 through the coolant inlet port 13*a* and the coolant discharge port 13*b* formed in an outer portion of the housing 10.

In addition, a plurality of grooves 15 are formed in upper and lower surfaces of the housing 10, respectively, and for example, three grooves 15 may be formed in the upper surface of the first panel 10*a*, three grooves 15 may be formed in the lower surface of the first panel 10*a*, three grooves 15 may be formed in the upper surface of the second panel 10*b*, and three grooves 15 may be formed in the lower surface of the second panel 10*b*.

The example in which the three grooves 15 are formed in each of the upper and lower surfaces of the first panel 10*a* and the second panel 10*b* of the housing 10 according to the exemplary embodiment of the present disclosure is described, but the present disclosure is not necessarily limited thereto, and the number of grooves 15 may vary as necessary.

Each of the plurality of grooves 15 protrudes toward the interior of the housing 10. Each of the plurality of grooves 15 may be formed together when the press process is performed on the first panel 10*a* and the second panel 10*b*.

In addition, a cup plate 17 is mounted at one end portion of the housing 10 and configured to introduce and discharge exhaust gas. Here, a partition stepped portion 17*a* is formed on a central portion of the cup plate 17 to introduce and discharge exhaust gas. That is, an exhaust gas inlet and an exhaust gas outlet may be defined by the partition stepped portion 17*a* formed on the cup plate 17.

In addition, a cap 19 is fitted at the other end portion of the housing. In other words, the cup plate 17, through which exhaust gas is introduced, is formed at one end portion of the housing 10, and the cap 19 is formed at the other end portion of the housing 10 to prevent an inflow of foreign substances.

The housing 10 is mounted at a necessary location by a bracket B formed at one side of an outer surface of the housing 10.

Further, each of the tubes 20 is formed in the form of a quadrangular box in which both end portions of each tube 20 in a traveling direction of exhaust gas are opened, such that the exhaust gas passageways in which exhaust gas moves are formed therein. Each of the tubes 20 has a rectangular cross section having a small height and a large width.

In addition, the multiple tubes 20 are stacked vertically in the housing 10. The multiple tubes 20 are mounted through fixing members 21 at both end portions thereof in a state in which the multiple tubes 20 are stacked vertically in the housing 10.

The fixing member 21 has slots 23 formed in a direction in which the tubes 20 are disposed so that tip portions of the multiple tubes 20 penetrate the slots 23 in predetermined section. In this case, one side fixing member 21, which is fitted with the cup plate 17, is fixed by the partition stepped portion 17*a* formed on the cup plate 17. In other words, the one side fixing member 21, which is fitted with the cup plate 17, is installed by the partition stepped portion 17*a* and a fitting groove 17*b* formed in one surface of the cup plate 17.

Further, the cooling fins 30 are installed in each of the tubes 20. The cooling fins 30 are formed in a predetermined pattern and selectively joined to upper and lower surfaces of each of the tubes 20. For example, the cooling fin 30 may have a concave-convex shape. That is, the cooling fins 30 are joined to the upper and lower surfaces of each of the tubes 20 while intersecting one another.

Further, the supporters 40 are disposed between the housing 10 and the tubes 20 and between the tubes 20. The supporters 40 serve to support the tubes 20 disposed at predetermined intervals. Each of the supporters 40 includes planar portions 41 and multiple convex portions 43 which are entirely distributed.

In more detail, an overall shape of each supporter 40 is a plate shape. Each of the supporters 40 includes the flat planar portions 41, and the multiple through holes 45 formed between the planar portions 41.

In addition, each supporter 40 has the multiple convex portions 43 each of which has a predetermined section which is disposed between the through holes 45 and protrudes toward one side. In this case, the supporter 40, which is disposed between the housing 10 and the tube 20, is disposed so that the plurality of grooves 15 are in contact with one side of the planar portion 41. An overall height of the supporter 40 is defined by the convex portion 43 and the supporter 40 supports the tube.

Referring to FIG. 4, the housing 10 of the EGR cooler 1 may have a two-layer structure including a first base material 100, and a first joining layer 110 joined to one side surface of the first base material 100.

In this case, the first base material 100 may be made of an A3000-based material including an aluminum-manganese (Al—Mn) alloy, e.g. an A0370 material. The first joining layer 110 may be made of an A4000-based material including an aluminum-silicon (Al—Si) alloy, e.g. an A4343 material.

Further, each of the tubes 20 includes a second base material 200 which is formed at a center thereof, diffusion prevention layers 210 which are formed on both outer surfaces of the second base material 200, respectively, and second joining layers 220 which are formed on outer surfaces of the diffusion prevention layers 210, respectively.

The diffusion prevention layer 210 serves to prevent the substance of the second base material 200 from being diffused toward other locations during the brazing process.

In this case, the second base material 200 may be made of an A3000-based material including an aluminum-manganese (Al—Mn) alloy, e.g. an A0328 material. The diffusion prevention layer 210 may be made of an A1000-based material including pure aluminum, e.g. an A0140 material. In addition, the second joining layer 220 is made of an A4000-based material including an aluminum-silicon (Al—Si) alloy, e.g. an A4045 material.

The supporter 40, which is disposed between the housing 10 and the tube 20 and configured as described above, has a portion which corresponds to the groove 15 and is joined by the first joining layer 110 and the second joining layer 220 of the tube 20 through the brazing process.

That is, the supporter 40, which corresponds to the groove 15 and the tube 20, is in direct contact with the housing 10 and the tube in the state of being interposed between the housing 10 and the tube, such that the supporter 40 is brazed by the first joining layer 110 and the second joining layer 220.

Here, the brazing is a joining method that uses a filler material having a melting temperature lower than a melting temperature of a base material to be joined and performs the joint process by melting only the filler material without melting the base material.

Therefore, in the EGR cooler 1, the housing 10 can be in direct contact with and joined to the tube 20 together with the supporter 40 through the plurality of grooves 15 formed in the upper and lower surfaces of the housing 10, and as a result, it is possible to prevent the tube 20 from sagging due to its own weight during the brazing process.

Furthermore, in the EGR cooler 1, the tubes 20 can be supported together with the plurality of grooves 15 and the support 40, and as a result, it is possible to prevent the tubes 20 from swelling.

For this reason, in the EGR cooler 1 according to the exemplary embodiment of the present disclosure, it is also possible to prevent exhaust gas from leaking from the housing 10.

While this invention has been described in connection with what is presently considered to be practical exemplary embodiments, it is to be understood that the invention is not limited to the disclosed embodiments, but on the contrary, is intended to cover various modifications and equivalent arrangements included within the spirit and scope of the appended claims.

What is claimed is:

1. An exhaust gas recirculation (EGR) cooler which receives exhaust gas and recirculates cooled exhaust gas, the EGR cooler comprising:

a housing, which has a cuboid shape, comprising:

an exhaust gas inlet and an exhaust gas outlet through which exhaust gas is introduced and discharged, respectively;

a coolant inlet and a coolant outlet through which a coolant for cooling the exhaust gas is introduced and discharged, respectively; and a plurality of grooves protruding inward from upper and lower surfaces of the housing;

a plurality of tubes spaced apart from each other in the housing so that exhaust gas, which flows from the exhaust gas inlet to the exhaust gas outlet, flows in the housing between the plurality of tubes; and a plurality of supporters supporting the plurality of tubes in the housing, wherein the plurality of supporters are disposed between an upper surface of the housing and a tube adjacent the upper surface of the housing among the plurality of tubes, between a lower surface of the housing and a tube adjacent the lower surface of the housing among the plurality of tubes, and between the plurality of tubes so that the plurality of supporters are disposed in a space in which the coolant flows inside the housing, wherein a supporter, which is disposed between the upper surface of the housing and the tube adjacent the upper surface of the housing, and a supporter, which is disposed between the lower surface of the housing and the tube adjacent the lower surface of the housing, are supported by the plurality of grooves and brazed together to be combined with the housing and the tube adjacent the upper surface of the housing and the tube adjacent the lower surface of the housing, respectively, wherein each of the plurality of supporters comprises:

flat planar portions;

a plurality of through holes between the planar portions; and a plurality of convex portions disposed between the plurality of through holes and protruding upwardly, and wherein each of the plurality of grooves is in contact with one side of each of the planar portions of the supporter, which is disposed between the upper surface of the housing and the tube adjacent the upper surface of the housing, and is further in contact with one side of each of the planar portions of the supporter, which is disposed between the lower surface of the housing and the tube adjacent the lower surface of the housing.

2. The EGR cooler of claim 1, wherein the housing has a first panel and a second panel, each of which has both ends bent inwardly in a longitudinal direction, wherein the both ends of the first panel are overlapped and connected with the both ends of second panel in the longitudinal direction, and wherein the plurality of grooves protrude inward in upper and lower surfaces of the first and second panels, respectively.

3. The EGR cooler of claim 1, wherein the housing has a two-layer structure including:

a first base material; and a first joining layer joined to one surface of the first base material, and each of the plurality of tubes has a five-layer structure including:

a second base material at a center of the tube;

diffusion prevention layers on outer surfaces of the second base material, respectively; and second joining layers on an outer surface of each of the diffusion prevention layers.

4. The EGR cooler of claim 3, wherein the supporter, which is disposed between the upper surface of the housing and the tube adjacent the upper surface of the housing, is brazed between the first joining layer of the housing and a second joining layer at an upper side of the tube adjacent the upper surface of the housing among the second joining layers.

5. The EGR cooler of claim 1, further comprising:

cooling fins disposed in each of the plurality of tubes and selectively joined, in a predetermined pattern, to upper and lower surfaces of each of the plurality of tubes.

6. The EGR cooler of claim 5, wherein the predetermined pattern has a concave-convex shape.

* * * * *